US009657739B2

(12) United States Patent
Frater et al.

(10) Patent No.: US 9,657,739 B2
(45) Date of Patent: May 23, 2017

(54) LOW-WEAR SLURRY PUMP

(75) Inventors: John Frater, Scottsdale, AZ (US); Ricky McGahee, Tucson, AZ (US)

(73) Assignee: FLSMIDTH A/S, Valby (DK)

( * ) Notice: Subject to any disclaimer, the term of this patent is extended or adjusted under 35 U.S.C. 154(b) by 373 days.

(21) Appl. No.: 14/111,599

(22) PCT Filed: Apr. 13, 2012

(86) PCT No.: PCT/US2012/033480

§ 371 (c)(1),
(2), (4) Date: Oct. 14, 2013

(87) PCT Pub. No.: WO2012/142386

PCT Pub. Date: Oct. 18, 2012

(65) Prior Publication Data

US 2014/0037440 A1 Feb. 6, 2014

Related U.S. Application Data

(60) Provisional application No. 61/475,631, filed on Apr. 14, 2011.

(51) Int. Cl.
*F04D 1/00* (2006.01)
*F04D 7/04* (2006.01)
(Continued)

(52) U.S. Cl.
CPC ..... *F04D 1/00* (2013.01); *F04D 7/04* (2013.01); *F04D 29/4286* (2013.01); *F04D 29/622* (2013.01)

(58) Field of Classification Search
CPC ..... F04D 29/622; F04D 29/42; F04D 29/86; F04D 29/2288; F04D 29/167; F04D 7/04; F04D 7/045; F04D 7/00; F04D 29/4286
See application file for complete search history.

(56) References Cited

U.S. PATENT DOCUMENTS 4,527,948 A * 7/1985 Addie ..... F04D 29/622 415/128
4,844,693 A * 7/1989 Grzina ..... F04D 29/428 415/197
(Continued)

FOREIGN PATENT DOCUMENTS

EP 1903216 A1 3/2008
GB 2055970 A 3/1981
(Continued)

OTHER PUBLICATIONS

The International Search Report and Written Opinion dated Jul. 5, 2012, 7 pages.

*Primary Examiner* — Gregory Anderson
*Assistant Examiner* — Maxime Adjagbe
(74) *Attorney, Agent, or Firm* — Jeffrey A. Sharp

(57) ABSTRACT

A centrifugal pump for a slurry combines design changes with respect to conventional configurations that produce quasi-laminar flow and materially extend the life of the casing. The cutwater clearance of the casing is increased to a range of 0.20 to 0.25 times the diameter of the impeller. The casing includes a redesigned removable annular liner with a diameter increased to at least 1.15 times the diameter of the impeller. The pump preferably also has an axially adjustable wear ring with a diameter increased such that it extends by at least 10% over the diameter of the area of interface between the wear ring and the impeller.

4 Claims, 10 Drawing Sheets

(51) Int. Cl.
*F04D 29/42* (2006.01)
*F04D 29/62* (2006.01)

(56) References Cited

U.S. PATENT DOCUMENTS

| | | | | |
|---|---|---|---|---|
| 4,893,986 | A | 1/1990 | Catterfeld et al. | |
| 5,813,833 | A | 9/1998 | Addie et al. | |
| 5,921,749 | A | 7/1999 | McLaurin et al. | |
| 2003/0035721 | A1 | 2/2003 | Addie et al. | |
| 2005/0163611 | A1* | 7/2005 | Walker ..... | F04D 29/4286 415/197 |

FOREIGN PATENT DOCUMENTS

| | | | |
|---|---|---|---|
| WO | 8504932 | A1 | 11/1985 |
| WO | 2005073514 | A1 | 8/2005 |

* cited by examiner

TYPICAL UMD

Cutwater Clearance: C
Impeller Diameter : D
Ratio C/D = 0.239

RANGE: 0.2 - 0.25

RATIO: G/H RANGE: 1.15 - 1.25

RATIO E/F RANGE: 1.100 - 1.140

LOW-WEAR SLURRY PUMP

CROSS-REFERENCE TO RELATED APPLICATIONS

This application claims the benefit of U.S. Provisional Application No. 61/475,631 filed on Apr. 14, 2011.

BACKGROUND OF THE INVENTION

Field of the Invention

This invention is related in general to the field of pumps for slurries. In particular, it relates to a centrifugal pump with a modified modular geometry that reduces wear and allows replacement of casing components to extend the service life of the pump.

Description of the Related Art

Mixtures of liquids and solids, such as slurries in mining and mineral processing operations, are typically moved using centrifugal pumps. The rotating impeller of the pump produces a pressure differential that moves the slurry from the axial input port to the radial discharge section of the pump. The centrifugal force generated by the impeller produces suction at the input port and causes the slurry to discharge at relatively high velocities with a radial component that produces abrasion on the inner wall of the peripheral portions of the casing.

In addition, slurry particles caught between the rotating impeller and the static walls of the casing produce wear on both components of the pump. This problem is more prevalent and critical on the suction side of the impeller because the high-pressure liquid in the discharge tends to flow toward the low-pressure zone in the suction section of the pump through the clearance between the rotating impeller and the static front casing wall. As the abrasion produced by such bypass flow widens this clearance, the amount of slurry recirculation increases and results in a loss of pump hydraulic performance and efficiency. Therefore, wear on the front suction side of the impeller is particularly undesirable. On the other hand, wear on the back side of the impeller is less significant because there is no bypass flow to the shaft side of the impeller.

As a result of this continuous abrasive action of the slurry on the impeller and the walls of the casing, slurry pumps ultimately fail and cause unintended shutdowns with attendant high economic losses. Therefore, periodic maintenance shutdowns are preferred and are regularly scheduled in order to minimize downtime. Typically, the life of the casing determines the ultimate length of service of a pump, but the liner at the suction side of the casing and the impeller need to be replaced one or more times at scheduled maintenance shutdowns during that time.

In order to reduce the wear caused by slurry particles moving between the impeller and the casing, expelling vanes have been used for decades in the clearance between the impeller and the casing walls around it. These vanes promote discharge of the particles and also reduce bypass recirculation, but this problem has persisted as a significant factor in causing undesirable downtime, whether planned or accidental.

The problem was addressed in U.S. Pat. No. 5,921,748, which disclosed a sealing arrangement that practically eliminates any augmentation in the clearance between the suction side of the impeller and the corresponding wall of the casing, thereby maintaining a relatively constant level of clearance and hydraulic performance during the life of the pump. An axially adjustable wear ring is added to the conventional pump configuration to substantially eliminate the clearance between the impeller and the casing wall in the suction zone of the pump. As the ring is worn over time, its position is adjusted by pushing it inward so as to maintain the appropriate seal with only sufficient clearance for the impeller to rotate freely with no significant bypass. In addition, in order to avoid wear caused by trapping, the '748 Patent also teaches an increase in the height of the expelling vanes and in the clearance between the vanes and the liner of the front suction wall of the casing beyond the largest particle size expected in the slurry.

While the seal and clearances taught in U.S. Pat. No. 5,921,748 represented a significant improvement in the art, long-term usage showed that additional wear problems remained unresolved. The wear and tear on the peripheral inner wall of the casing remains a critical limiting factor in the life of the pump casing. In addition, while bypass recirculation was dramatically reduced by the '748 invention by decreasing the pressure at the interface between the impeller and the wear ring, the higher expelling vanes and clearance between the impeller and the casing front wall proved to create localized increases in slurry turbulence that produce very high abrasion on the casing liner, both at its interface with the casing and its interface with the wear ring. As a result, the performance of the pump was improved materially, but wear and tear on the peripheral wall of the casing and at its interface with the front liner remains a problem and there is still a need for a pump-casing design that affords a service life commensurate with that of the other parts of the pump casing.

BRIEF SUMMARY OF THE INVENTION

The invention lies in a centrifugal pump with the combination of several design changes with respect to conventional configurations. The pump has a casing with an impeller region and a volute region with as cutwater clearance, as these are conventionally defined, and an impeller adapted to rotate within the impeller region. The cutwater clearance is increased to a range of 0.20 to 0.25 times the diameter of the impeller, which represents an approximate 50% increase over conventional designs in the art. In addition, the casing includes a redesigned removable annular liner that defines the suction side of the casing. The outer diameter of the liner is increased to at least 1.15 times the diameter of the impeller, as compared to conventional designs of substantially equal diameters. In the preferred embodiment of the invention for mining applications the annular liner has a diameter about 1.18 to about 1.22 times the diameter of the impeller.

The pump of the invention is preferably also combined with the axially adjustable wear ring taught by U.S. Pat. No. 5,921,748 between the annular liner and the suction side of the impeller. In addition, the same plurality of raised expelling vanes is added to the suction side of the impeller, leaving a clearance between the vanes and the annular liner greater than the size of the largest solid particle expected in the particle size distribution of the slurry. In such cases, according to the invention, the diameter of the wear ring is increased such that it extends by at least 10% over the diameter of the area of interface between the wear ring and the impeller.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS OF THE INVENTION

The invention lies in the combination of changes in the conventional configuration of the casing used in a centrifugal slurry pump of the type disclosed in U.S. Pat. No. 5,921,748. Accordingly, this prior-art pump is used to describe the changes. One aspect of the invention consists in augmenting the ratio of the diameter of the casing to that of the impeller to increase the residence time of the slurry in the volute section of the pump, thereby reducing the radial component of the velocity with which the larger solid particles in the slurry impact and abrade the casing's peripheral surface. The portion of the casing facing the suction side of the impeller is converted to a modular section with a wear liner, thereby enabling its replacement during scheduled maintenance shutdowns as necessary to match the longer service life of the rest of the casing. According to another aspect of the invention, this section is redesigned to a geometry that has been found to materially affect its life.

As used in the art, the part of the casing of the centrifugal pump that receives the fluid being pumped by the impeller is referred to as the "volute." That is, the volute is that portion of the pump casing that defines the volume outside the space occupied by the impeller. By being shaped as a curved funnel that increases in cross-section as it approaches the discharge port, the volute of the pump converts the kinetic energy imparted by the impeller into pressure by reducing the fluid's speed, thereby balancing the hydraulic pressure acting on the shaft of the pump. The minimum clearance between the impeller and casing is referred to as the "cutwater clearance," such clearance being optimally minimal when only water is being pumped. The terms "suction" and "front" are used interchangeably as modifiers referring to the suction side of the pump. The opposite, shaft side of the pump is referred to interchangeably as the "back" side or the "gland" side. The term "slurry" is used with its normal meaning to refer to a fluid mixture of solid particles in a liquid, such mixture being fluid in the sense of being capable to being transported in a pipe under the propelling action of a pump.

Figure 1:
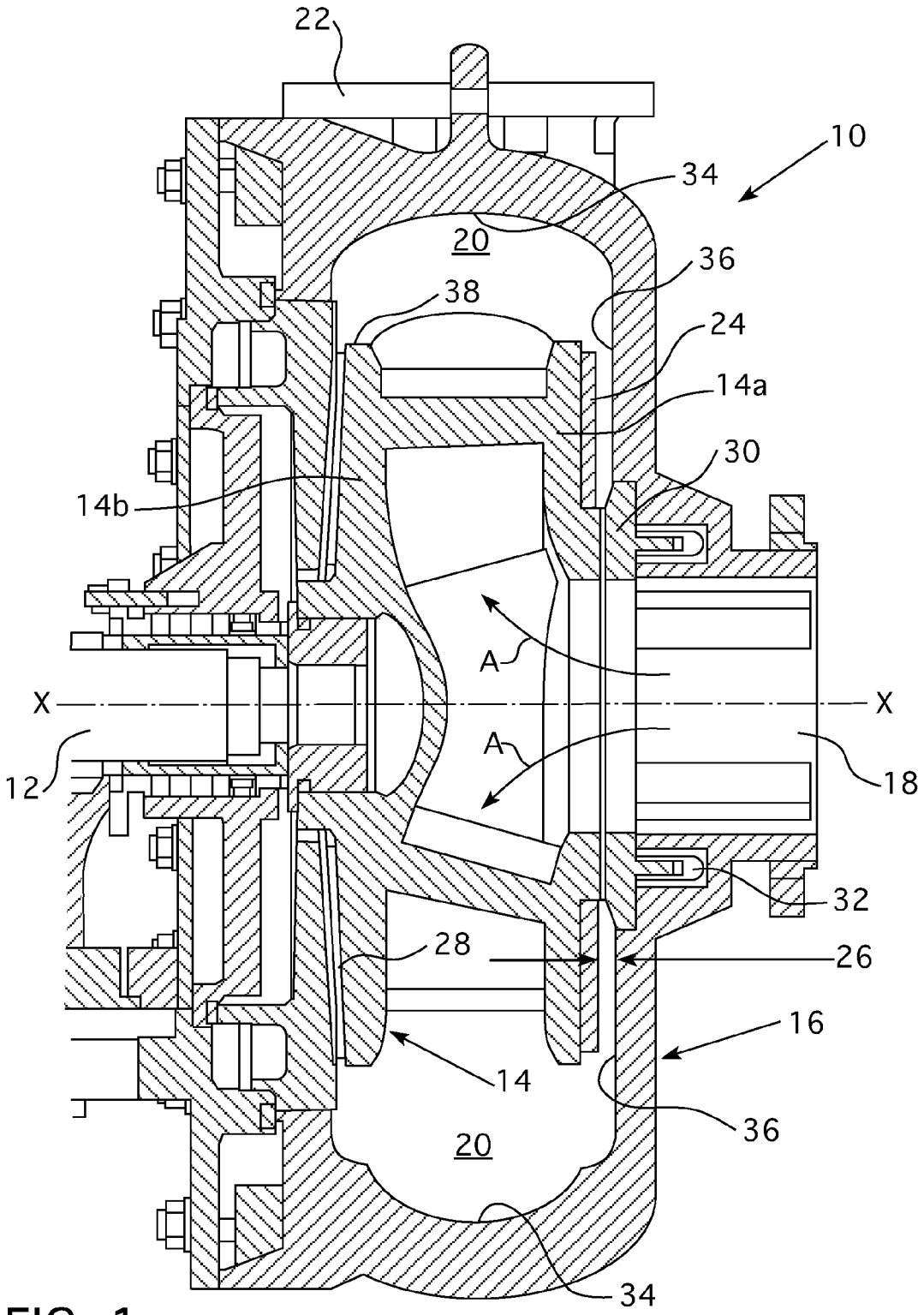
FIG. 1 (Prior Art)
FIG. 1 is a cross-section of a prior-art pump as taught by U.S. Pat. No. 5,921,748.

Referring to the figures, wherein the same reference numerals and symbols are used for like parts, a centrifugal pump according to U.S. Pat. No. 5,921,748 is shown in FIG. 1 to illustrate the changes introduced by the invention. The pump 10 comprises a shaft 12, an impeller 14, and a static casing 16. The impeller comprises a suction side 14*a* and a gland side 14*b*. The impeller 14 is driven by a motor (not shown) via the shaft 12 and rotates about the axis X—X inside the static casing 16 of the pump. The slurry enters the pump via the intake throat 18 and is forced at high velocity through the rotating impeller (see arrows A) into the high-pressure region inside the pump volute 20, from where it is discharged via the discharge pipe 22.

The suction side 14*a* of the impeller is preferably provided with a plurality of radially arranged expelling vanes 24. The clearance 26 between the vanes 24 and the pump casing 16 is preferably greater than the predicted size of the largest solid particle in the normal design distribution of the slurry to be pumped. This is to prevent abrasive solids from becoming trapped between the rotating impeller vanes 24 and the pump casing 16. When the pump is running, the vanes 24 reduce the hydraulic pressure in the region between the impeller suction side 14*a* and the casing 16 to help prevent slurry from flowing into the clearance 26. Preferably, the gland side 14*b* of the impeller is also provided with a plurality of radially disposed vanes 28 formed in the surface of the impeller.

A substantially annular wear ring 30 is provided in a recess of the pump casing 14 and in use it is axially adjusted so as to be closely adjacent to the surface of the impeller suction side 14*a*. The wear ring 30 effectively seals the space between the impeller and the pump casing, reducing the bypass flow of slurry from the high-pressure volute 20 back into the low-pressure intake 18. Therefore, abrasive particles are less likely to become trapped between the impeller and the casing. The wear ring 30 is mounted on a carrier 32 that is axially adjustable, as the need arises as a result of wear, by means of adjustment screws (not shown) from the exterior of the pump casing. Thus, adjustments can be made advantageously without stopping the pump.

Figure 2:
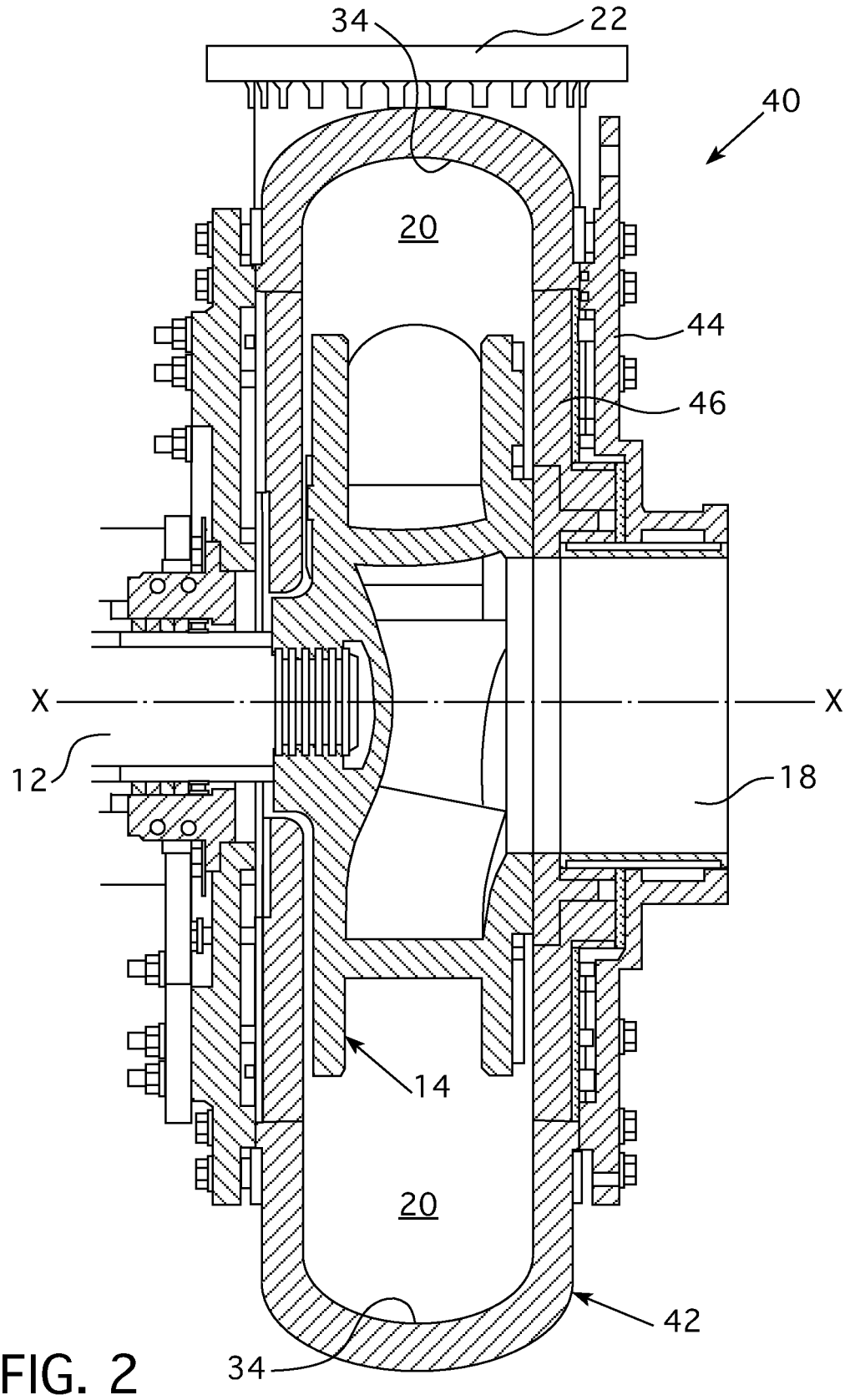
FIG. 2 is a cross-section of a pump according to the invention.
Figure 3:
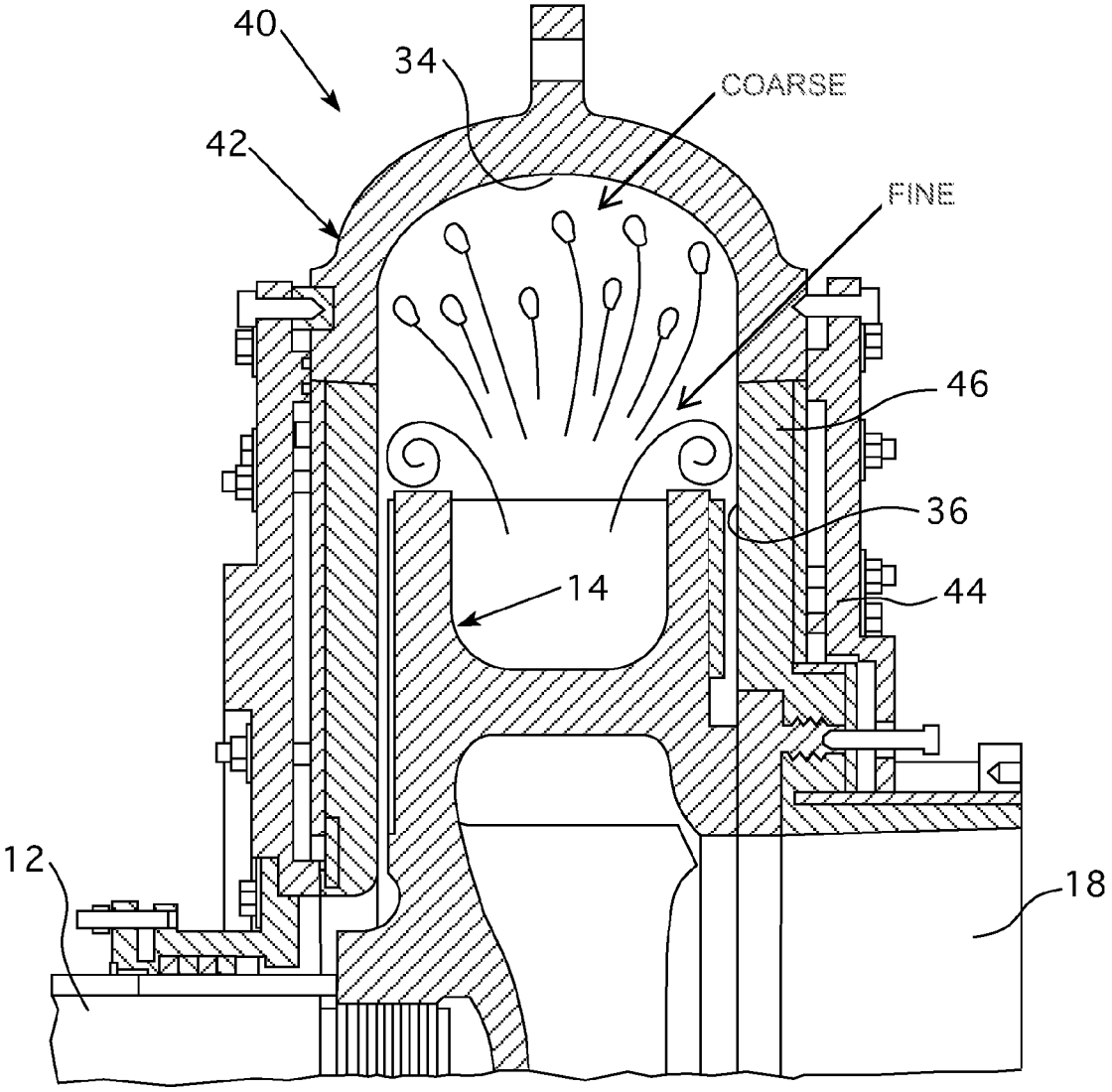
FIG. 3 is a schematic sectional illustration of the impeller and volute regions of the pump of the invention showing roughly the size distribution of the solids seen in the slurry being pumped by the pump of the invention.

As illustrated in FIG. 2, the pump 40 of the present invention exhibits a casing 42 with an augmented diameter, in relation to the conventional design of the pump disclosed in the '748 Patent, so as to provide a thicker bed of rotating slurry to deflect the radial trajectory of the larger solids exiting the impeller and reduce the velocity with which the solid particles being pumped impact the peripheral wall 34 of the casing. Moreover, as illustrated in FIG. 3, large particles in the slurry that rotate more slowly at the outer periphery of the casing provide a bed of material that further reduces the abrasive impact of solids in the wall 34 of the casing.

However, in addition to the foregoing, the increase in the casing/impeller diameter ratio was also found to provide the unexpected result of materially changing the nature of the slurry flow in the volute 20 of the pump. As illustrated in the axial cross-section of FIG. 4, the velocity profile of the slurry in pump 10 of FIG. 1 shows multiple areas of high speed at locations close to the wall 34 of the pump casing. The velocity profile also illustrates a high degree of turbulence (as shown by radial velocity gradients), especially in the region near the discharge pipe 22 of the pump. As one skilled in the art would readily understand, turbulence in the flow of a slurry is a material factor in producing abrasion and wear in pipe walls. By contrast, it was discovered that an increase in cutwater clearance, as taught by the present invention, in addition to the advantages mentioned above, also produces a quasi-laminar flow in the slurry, as shown by the velocity diagram of FIG. 5. The uniformity of flow velocity and the attendant lack of turbulence illustrated in FIG. 5 were totally unexpected, but they provide an extremely positive additional benefit because they contribute materially to drastically reducing the wear on the peripheral wall 34 of the casing of pump 40 of FIG. 2 with respect to the wear experienced with pump 10 of FIG. 1 while operating under equivalent conditions.

Figure 5:
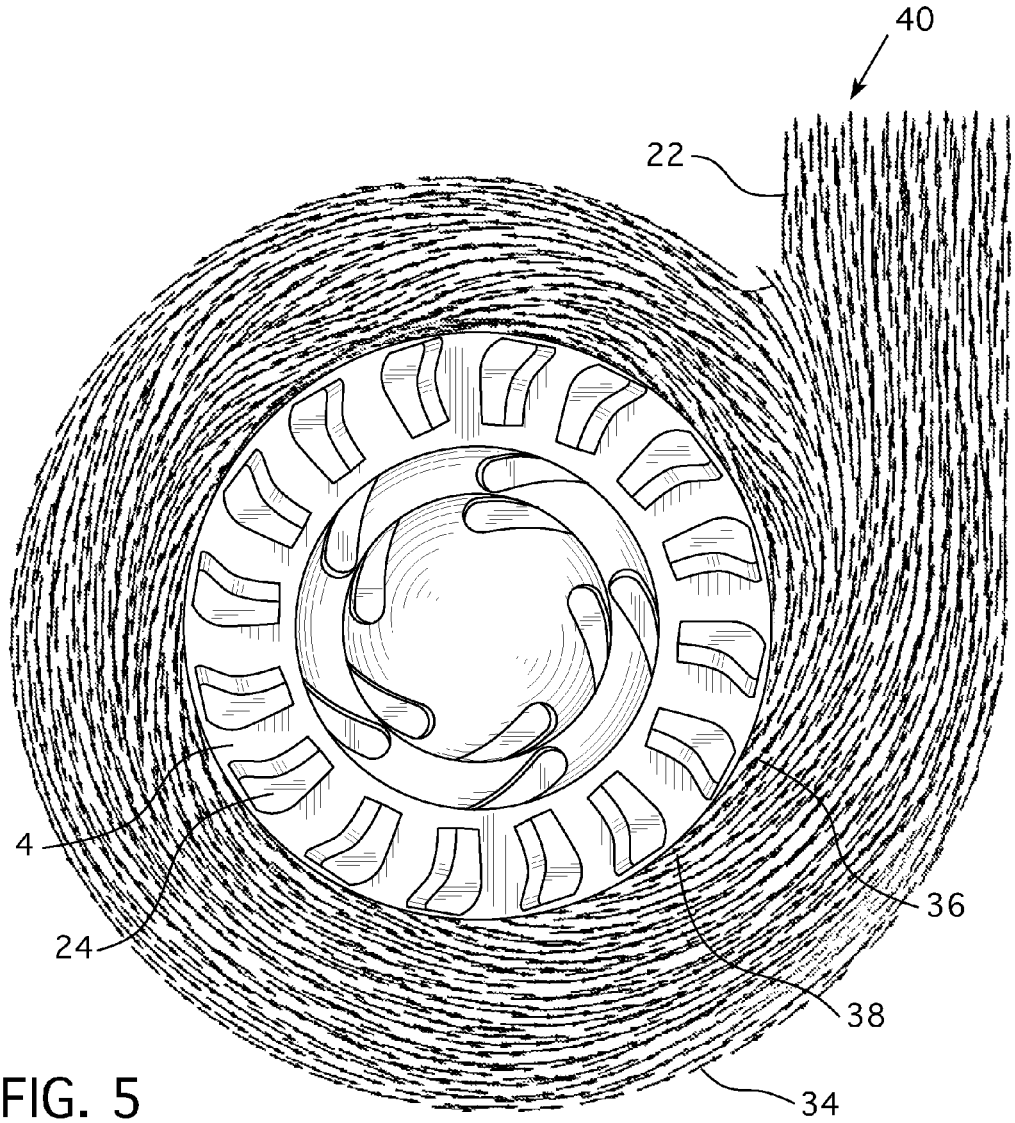
FIG. 5 is an illustration of the improved slurry flow profile through the pump of FIG. 2, showing the quasi-laminar flow produced by augmenting the depth of the volute according to the invention.
Figure 6:
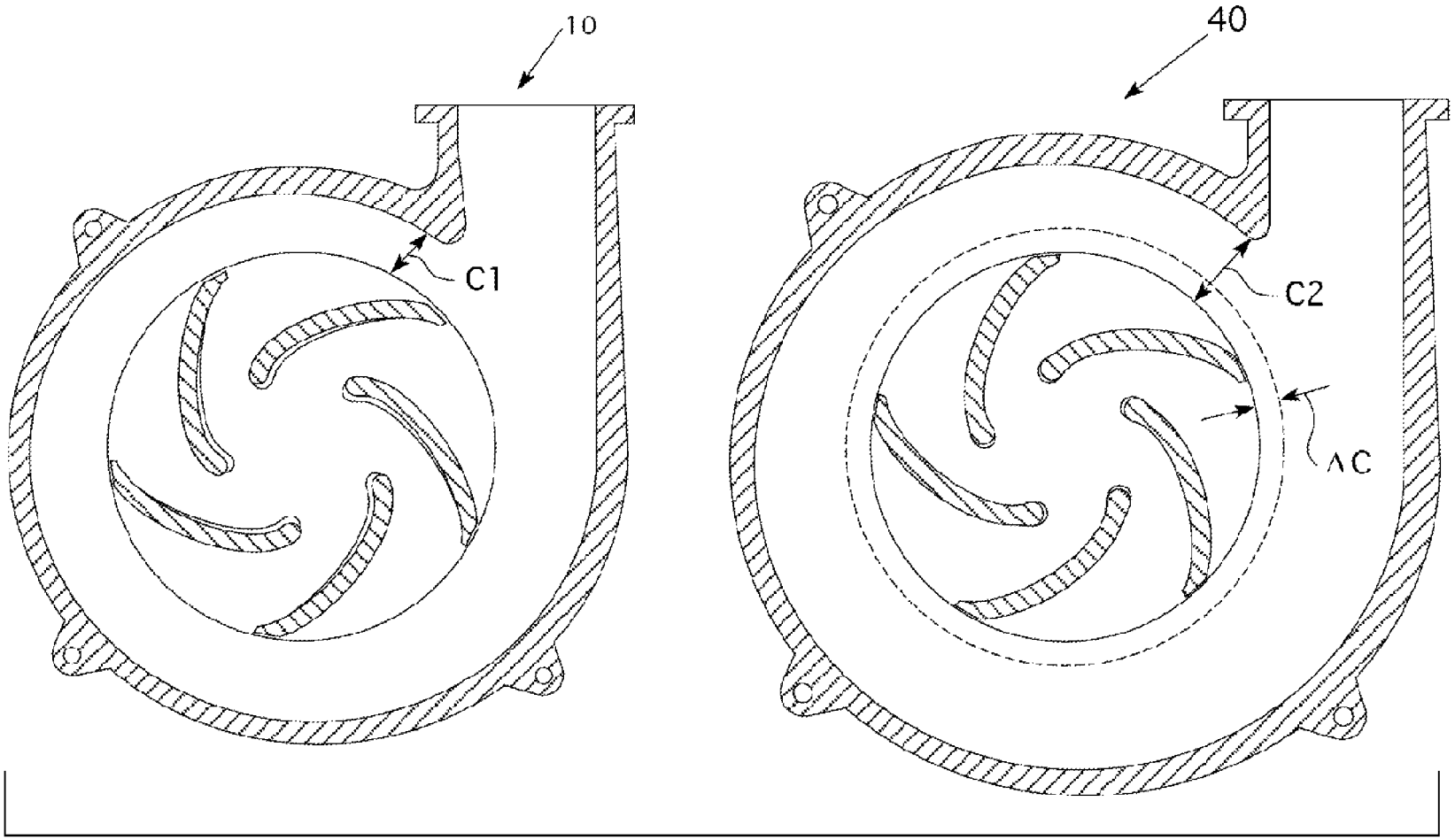
FIG. 6 illustrates the increase in volute depth implemented on the pump of FIG. 1 in order to achieve the flow improvements exhibited by the pump of FIG. 2.

Those skilled in the art will recognize that the volute of a centrifugal pump is characterized by a progressively increasing diameter. Thus, for the purpose of clarity, an increase in the diameter of the casing is intended to refer to an increase in the cutwater clearance of the pump with no material change in the progressively increasing profile of the casing. For example, as illustrated in FIG. 6, the flow profile of FIG. 5 was achieved by increasing the cutwater clearance C1 of the casing of pump 10 by the amount ΔC to obtain the clearance C2 of pump 40. While the precise amount of augmentation needed to achieve the goals of the invention is understood to depend on the type of slurry being pumped, it is estimated that a cutwater clearance-to-impeller diameter ratio C/D in the range of 0.20 to 0.25, as illustrated in FIG. 7, is necessary to obtain the improved flow and wear results of the invention.

Figure 4:
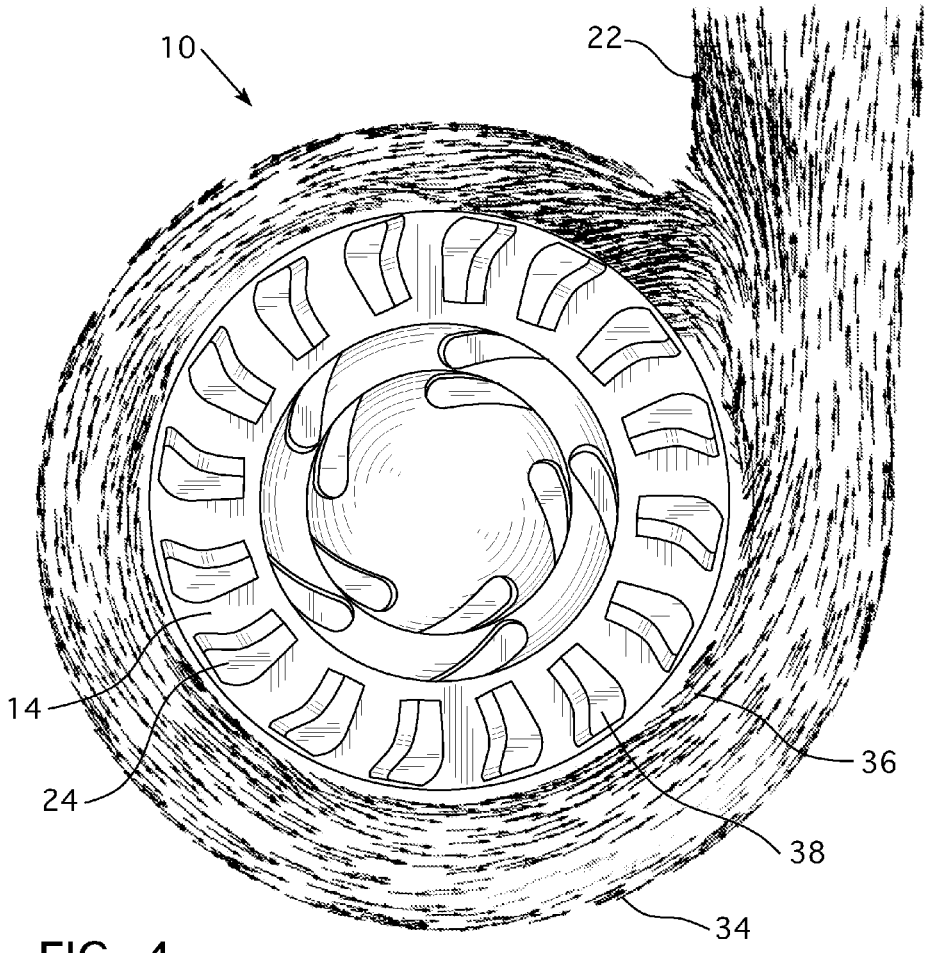
FIG. 4 is an illustration of the slurry flow profile through the pump of FIG. 1, showing irregular velocity gradients that produce turbulence.

Another problem with the pump configuration of FIG. 1 has been the relatively higher wear experienced in the annular region 36 of the suction wall of the casing 16 (see FIG. 1). To address this problem, some pump casings have been designed to include a modular suction-side component with an annular liner intended for periodic replacement. These liners have been sized with an outer diameter approximating the diameter of the impeller and an inner diameter such that the liner buts against the wear ring where the ring interfaces with the impeller. However, as discovered from information as provided by FIG. 4, the annular region 36 of high turbulence extends radially a distance about 15% of the impeller's radius from the outer rim 38 of the impeller 14. The region 36 also extends about 10-15% below the rim 38 of the impeller. FIG. 4 shows the high degree of turbulence encountered in this region, which explains the correspondingly very high wear suffered by the casing 16 in the annular region 36 as compared to the rest of the casing, including the peripheral wall 34. Though the overall turbulence is greatly diminished by the extended-cutwater-clearance design of a pump such as pump 40 of FIG. 2, a relatively high degree of turbulence remains in the same annular region of the front wall of the casing, as seen in FIG. 5. This problem has proven over time to be the limiting factor in the life of the pump even when a replaceable liner is used because, while the impeller and the liner may be replaced periodically at scheduled shutdowns, the concurrent damage to this area of the permanent portion of the casing at times does not warrant their replacement. Therefore, any solution that extends the life of the permanent portion of the casing also extends the life of the pump.

Figure 7:
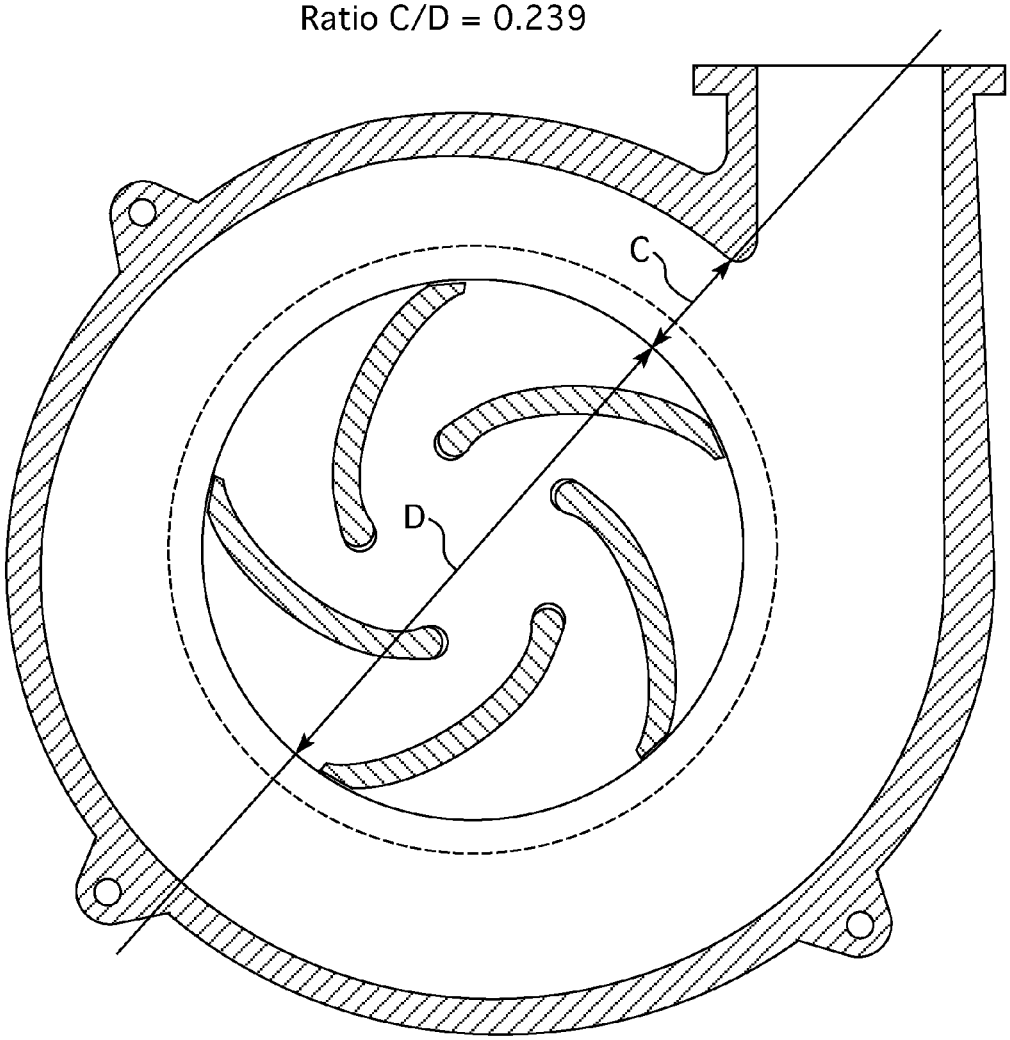
FIG. 7 illustrated the increased cutwater clearance-to-impeller diameter ratio taught by the invention.
Figure 8:
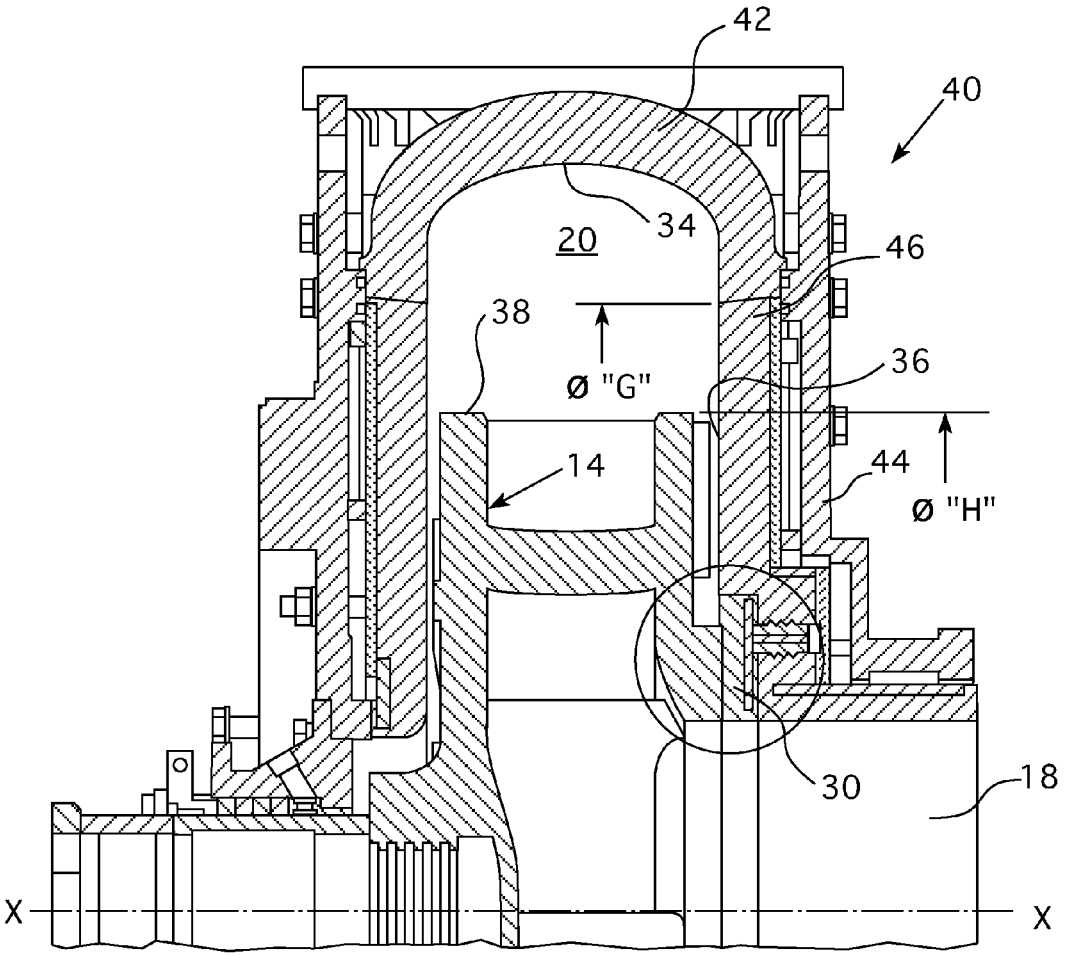
FIG. 8 is the same cross-section of FIG. 3 showing in more detail the modular liner component of the front portion of the casing according to the invention.

This problem has been addressed by providing a modular component 44 in the front portion of the casing that supports a liner 46 constituting the inner wall of the casing, as illustrated in FIGS. 2, 3 and 7. According to the invention, the annular liner 46 is sized with an outer diameter G between 15% and 25% (preferably 18%-22%) greater than the diameter D of the impeller 14 (see FIG. 8, in particular). The preferred material for the liner 46 is selected conventionally based on the slurry being pumped. However, this modular structure of the front wall of the casing makes it possible to replace it, without changing the entire casing, when the higher wear experienced in the region 36 close to the rim of the impeller warrants replacements, typically and advantageously during already scheduled downtime for impeller maintenance.

Figure 9:
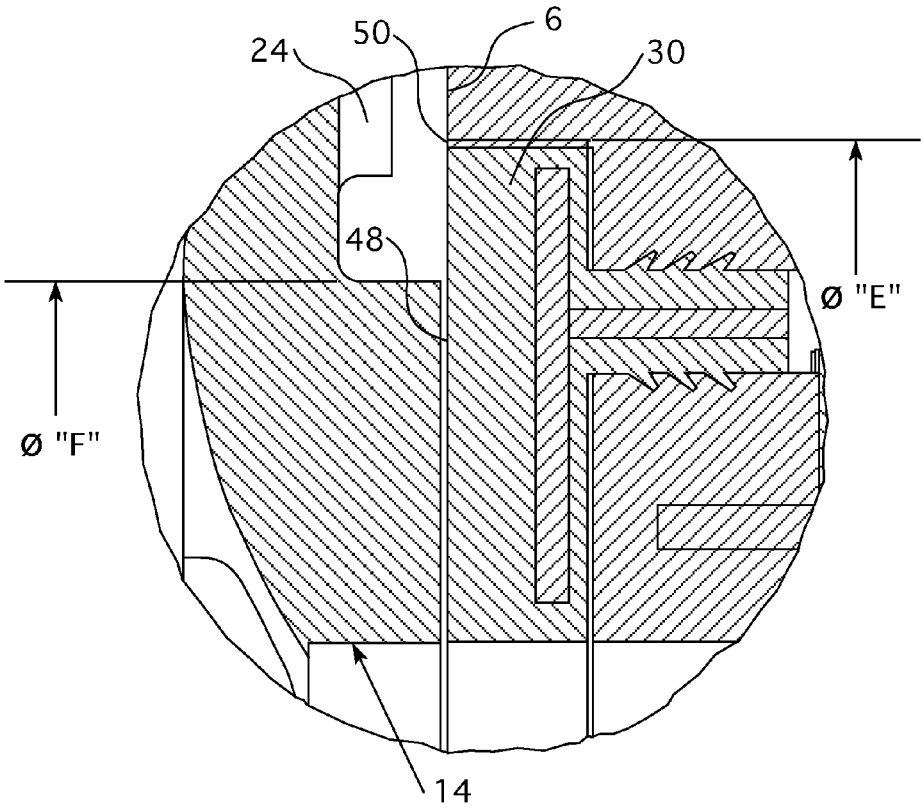
FIG. 9 is an enlarged view of the encircled area in FIG. 8.

As mentioned above, when a wear ring 30 is used as taught by U.S. Pat. No. 5,921,748, the turbulence produced by the expelling vanes 24 in the region of interface between the wear ring and the impeller causes a significant erosion of the suction liner where it interfaces with the wear ring. This wear eventually produces a failure of the liner as a seal and a support structure for the wear ring; therefore, it is a serious problem that affects the life of the both components. Thus, according to another aspect of the invention, the diameter of the wear ring is increased such that it extends past the area of turbulence created by the raised expelling vanes near the interface between the wear ring and the impeller. As illustrated in FIG. 9, the diameter E of the wear ring 30 is increased to between 10% and 14% larger than the diameter F of the surface 48 of interface between the wear ring and the impeller 14. This dimension is found to be sufficient to remove the section 50 of abutment between the ring 30 and the liner 46 from the turbulence created by the vanes 24 as needed to provide a material improvement in the wear of the liner.

Experimental tests have demonstrated that the pump 40 of the invention is capable of operating without failure way beyond the service life of comparable pumps that do not incorporate the extended diameter design and the replaceable suction-liner features disclosed herein. In fact, the much reduced wear in the peripheral wall 34 produced by the extended casing diameter combined with a replaceable suction liner 46 and a wear ring 30 sized as described make it possible to continue operating with the same permanent casing 42 for a yet undetermined service life, subject only to routine maintenance shutdowns to replace the impeller, the liner, the wear ring, and other parts, as needed.

Figure 10:
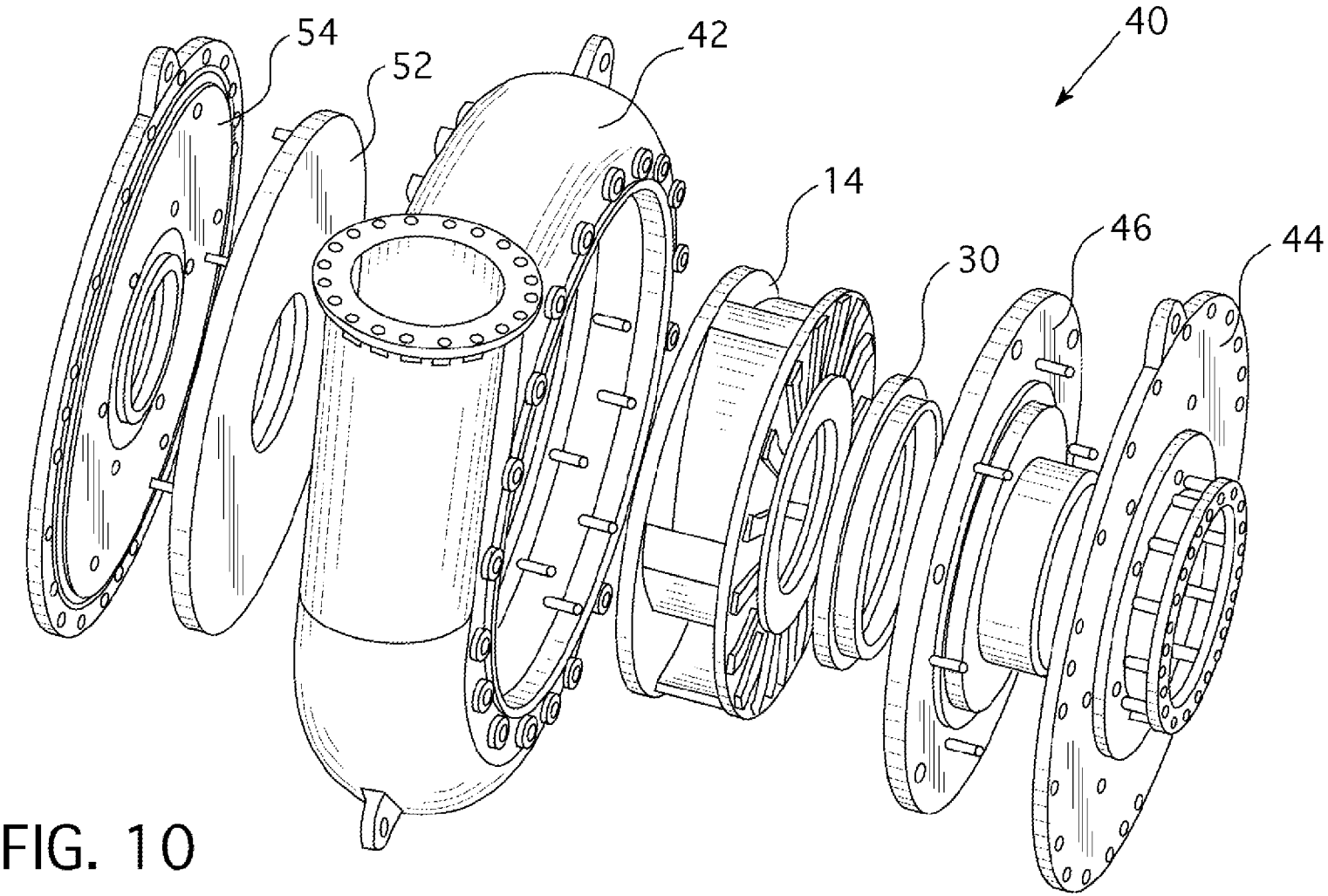
FIG. 10 is an exploded view showing the major components of a pump according to the preferred embodiment of the invention.

FIG. 10 shows in simplified exploded view the various components of the preferred embodiment of the invention. In essence, the major components of the pump 40 include a casing 42 and an impeller 14 enclosed by the modular casing component 44 and liner 46. The wear ring 30 provides the seal between the volute and the suction region of the pump. The gland side of the casing is enclosed by a conventional back liner 52 and back plate 54. While the wear ring 30 is not novel, its novel optimal sizing and use in conjunction with the extended cutwater clearance and the larger suction liner of the invention are preferred to implement the invention.

Various changes in the details, steps and components that have been described may be made by those skilled in the art within the principles and scope of the invention herein illustrated and defined in the appended claims. Therefore, while the invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

The invention claimed is:

1. A centrifugal pump for a slurry comprising:

a pump casing [42] defining an impeller region, a volute region [20], and a corresponding cutwater clearance [C, C2]; and an impeller [14] adapted to rotate within the impeller region, said impeller having a predetermined diameter;

wherein the casing [42] comprises a removable annular liner [46] in a suction side of the casing [42], said liner [46] having a diameter [G] at least 1.15 times said diameter [D] of the impeller [14]; and the cutwater clearance [C, C2] is between 0.20 and 0.25 times said diameter [D] of the impeller [14];

the centrifugal pump further comprising an axially adjustable wear ring [30] between said annular liner [46] and a suction side of the impeller [14] which can be adjusted in its position as the wear ring [30] is worn over time, said wear said ring [30] having an outer diameter [E] between 10% and 14% larger than a diameter [F] of a surface [48] of interface between the wear ring [30] and the impeller [14].

2. The pump of claim 1, wherein said removable annular liner [46] has a diameter [G] about 1.18 to about 1.22 times said diameter [D] of the impeller [14].

3. The pump of claim 1, further comprising a plurality of raised expelling vanes [24] on a suction side of the impeller [14], said vanes [24] defining a clearance between the vanes [24] and the annular liner [46] greater than a size of a largest solid particle in a particle size distribution of said slurry.

4. The pump of claim 3, wherein said removable annular liner [46] has a diameter [G] about 1.18 to about 1.22 times said diameter [D] of the impeller [14].

* * * * *